US008891990B2

(12) United States Patent
Yuasa et al.

(10) Patent No.: US 8,891,990 B2
(45) Date of Patent: Nov. 18, 2014

(54) IMAGE FORMING APPARATUS AND METHOD FOR FORMING TONER IMAGE ON RECORDING MEDIUM

(75) Inventors: Shuutaroh Yuasa, Kanagawa (JP); Tadashi Ogawa, Tokyo (JP); Takeshi Uchitani, Kanagawa (JP); Satoshi Ueno, Tokyo (JP); Teppei Kawata, Kanagawa (JP); Takamasa Hase, Tokyo (JP); Kazuya Saito, Kanagawa (JP); Kensuke Yamaji, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 320 days.

(21) Appl. No.: 13/200,592

(22) Filed: Sep. 27, 2011

(65) Prior Publication Data

US 2012/0093531 A1 Apr. 19, 2012

(30) Foreign Application Priority Data

Oct. 18, 2010 (JP) ..... 2010-233752

(51) Int. Cl.
*G03G 15/20* (2006.01)

(52) U.S. Cl.
CPC ..... *G03G 15/2032* (2013.01)
USPC ..... 399/69; 399/67

(58) Field of Classification Search
USPC ..... 399/67, 69
See application file for complete search history.

(56) References Cited

U.S. PATENT DOCUMENTS 5,111,249 A * 5/1992 Owada ..... 399/69
7,120,370 B2 * 10/2006 Watabe ..... 399/67
7,266,336 B2 9/2007 Ueno et al.
7,450,872 B2 11/2008 Ueno et al.
7,491,917 B2 2/2009 Ueno
7,509,085 B2 3/2009 Yoshinaga et al.
7,546,049 B2 6/2009 Ehara et al.
7,672,605 B2 3/2010 Kayahara et al.

(Continued)

FOREIGN PATENT DOCUMENTS

JP 11-125985 A 5/1999
JP 2005114959 A 4/2005

(Continued)

OTHER PUBLICATIONS

Hori et al. Translation of Japanese Patent Publication No. JP2009014829. Published Jan. 2009.*

(Continued)

*Primary Examiner* — Walter L Lindsay, Jr.
*Assistant Examiner* — Philip Marcus T Fadul
(74) *Attorney, Agent, or Firm* — Harness, Dickey & Pierce

(57) ABSTRACT

An image forming apparatus includes a fixing device disposed downstream from an image forming device in a recording medium conveyance direction to fix a toner image formed by the image forming device on a recording medium. The fixing device includes a pressing rotary body separatably pressed against a fixing rotary body to form a nip therebetween through which the recording medium bearing the toner image passes, and a moving assembly to move the pressing rotary body bidirectionally to press the pressing rotary body against the fixing rotary body and separate the pressing rotary body from the fixing rotary body. A controller controls the moving assembly to change a post-fixing pressing time period for which the moving assembly presses the pressing rotary body against the fixing rotary body after the recording medium bearing the toner image is discharged from the nip according to image data.

17 Claims, 7 Drawing Sheets

(56) References Cited

U.S. PATENT DOCUMENTS

| | | | | |
|---|---|---|---|---|
| 7,693,439 | B2 | 4/2010 | Seo et al. | |
| 7,715,774 | B2 | 5/2010 | Ueno | |
| 7,734,208 | B2 | 6/2010 | Seo et al. | |
| 7,778,581 | B2 | 8/2010 | Seo et al. | |
| 7,783,240 | B2 | 8/2010 | Ito et al. | |
| 7,796,933 | B2 | 9/2010 | Ueno et al. | |
| 7,801,457 | B2 | 9/2010 | Seo et al. | |
| 7,817,952 | B2 | 10/2010 | Seo et al. | |
| 7,885,590 | B2 | 2/2011 | Seo et al. | |
| 7,925,177 | B2 | 4/2011 | Ishii et al. | |
| 7,983,582 | B2 | 7/2011 | Hase | |
| 8,014,711 | B2 | 9/2011 | Ito et al. | |
| 2005/0191098 | A1 | 9/2005 | Ueno et al. | |
| 2006/0029411 | A1 | 2/2006 | Ishii et al. | |
| 2006/0165443 | A1 | 7/2006 | Yoshinaga et al. | |
| 2006/0289419 | A1 | 12/2006 | Ueno | |
| 2007/0014600 | A1 | 1/2007 | Ishii et al. | |
| 2007/0059011 | A1 | 3/2007 | Seo et al. | |
| 2007/0201916 | A1 | 8/2007 | Ueno | |
| 2007/0212089 | A1 | 9/2007 | Seo et al. | |
| 2007/0264060 | A1 | 11/2007 | Ueno et al. | |
| 2007/0280754 | A1 | 12/2007 | Ogawa et al. | |
| 2008/0025772 | A1 | 1/2008 | Seo et al. | |
| 2008/0025773 | A1 | 1/2008 | Ito et al. | |
| 2008/0044196 | A1 | 2/2008 | Seo et al. | |
| 2008/0199197 | A1* | 8/2008 | Suzuki et al. | 399/67 |
| 2008/0219721 | A1 | 9/2008 | Ito et al. | |
| 2008/0226326 | A1 | 9/2008 | Seo et al. | |
| 2008/0232873 | A1 | 9/2008 | Ueno et al. | |
| 2009/0148205 | A1 | 6/2009 | Seo et al. | |
| 2009/0245897 | A1 | 10/2009 | Seo et al. | |
| 2009/0297197 | A1 | 12/2009 | Hase | |
| 2010/0014903 | A1 | 1/2010 | Seto et al. | |
| 2010/0061753 | A1 | 3/2010 | Hase | |
| 2010/0158553 | A1 | 6/2010 | Ueno | |
| 2010/0232844 | A1 | 9/2010 | Saito et al. | |
| 2010/0239292 | A1 | 9/2010 | Fujita et al. | |
| 2010/0303521 | A1 | 12/2010 | Ogawa et al. | |
| 2011/0026988 | A1 | 2/2011 | Yoshikawa et al. | |
| 2011/0044734 | A1 | 2/2011 | Shimokawa et al. | |
| 2011/0052237 | A1 | 3/2011 | Yoshikawa et al. | |
| 2011/0052277 | A1 | 3/2011 | Ueno et al. | |
| 2011/0058862 | A1 | 3/2011 | Yamaguchi et al. | |
| 2011/0058863 | A1 | 3/2011 | Shinshi et al. | |
| 2011/0064443 | A1 | 3/2011 | Iwaya et al. | |
| 2011/0064450 | A1 | 3/2011 | Ishii et al. | |
| 2011/0064490 | A1 | 3/2011 | Imada et al. | |
| 2011/0064502 | A1 | 3/2011 | Hase et al. | |
| 2011/0085832 | A1 | 4/2011 | Hasegawa et al. | |
| 2011/0091253 | A1 | 4/2011 | Seo et al. | |
| 2011/0116848 | A1 | 5/2011 | Yamaguchi et al. | |
| 2011/0129268 | A1 | 6/2011 | Ishii et al. | |
| 2011/0150518 | A1 | 6/2011 | Hase et al. | |
| 2011/0176821 | A1* | 7/2011 | Hase | 399/45 |
| 2011/0182638 | A1 | 7/2011 | Ishii et al. | |
| 2011/0194869 | A1 | 8/2011 | Yoshinaga et al. | |
| 2011/0194870 | A1 | 8/2011 | Hase et al. | |
| 2011/0200368 | A1 | 8/2011 | Yamaguchi et al. | |
| 2011/0200370 | A1 | 8/2011 | Ikebuchi et al. | |
| 2011/0206427 | A1 | 8/2011 | Iwaya et al. | |
| 2011/0217056 | A1 | 9/2011 | Yoshinaga et al. | |
| 2011/0217093 | A1 | 9/2011 | Tokuda et al. | |
| 2011/0217095 | A1 | 9/2011 | Ishii et al. | |
| 2011/0222875 | A1 | 9/2011 | Imada et al. | |
| 2011/0222876 | A1 | 9/2011 | Yuasa et al. | |
| 2011/0222888 | A1 | 9/2011 | Ikebuchi et al. | |
| 2011/0222926 | A1 | 9/2011 | Ueno et al. | |
| 2011/0222929 | A1 | 9/2011 | Fujimoto et al. | |
| 2011/0222930 | A1 | 9/2011 | Fujimoto et al. | |
| 2011/0222931 | A1 | 9/2011 | Shinshi et al. | |
| 2011/0229161 | A1 | 9/2011 | Ueno et al. | |
| 2011/0229162 | A1 | 9/2011 | Ogawa et al. | |
| 2011/0229178 | A1 | 9/2011 | Ogawa et al. | |
| 2011/0229180 | A1 | 9/2011 | Saito | |
| 2011/0229181 | A1 | 9/2011 | Iwaya et al. | |
| 2011/0229225 | A1 | 9/2011 | Ishii et al. | |
| 2011/0229226 | A1 | 9/2011 | Tokuda et al. | |
| 2011/0229227 | A1 | 9/2011 | Yoshikawa et al. | |
| 2011/0229228 | A1 | 9/2011 | Yoshikawa et al. | |
| 2011/0229236 | A1 | 9/2011 | Ehara et al. | |
| 2011/0274453 | A1 | 11/2011 | Shimokawa et al. | |
| 2011/0311284 | A1 | 12/2011 | Seo et al. | |

FOREIGN PATENT DOCUMENTS

| | | | | |
|---|---|---|---|---|
| JP | 2005201917 | A | | 7/2005 |
| JP | 3736240 | B2 | | 11/2005 |
| JP | 2006313227 | A | | 11/2006 |
| JP | 2009014829 | A | * | 1/2009 |
| JP | 2010181728 | A | | 8/2010 |

OTHER PUBLICATIONS

Abstract of Japanese Patent Publication JP 2001-154529.
Japanese Office Action dated Feb. 25, 2014 for corresponding Japanese Application No. 2010-233752.

* cited by examiner

IMAGE FORMING APPARATUS AND METHOD FOR FORMING TONER IMAGE ON RECORDING MEDIUM

CROSS-REFERENCE TO RELATED APPLICATIONS

This patent application is based on and claims priority pursuant to 35 U.S.C. §119 to Japanese Patent Application No. 2010-233752, filed on Oct. 18, 2010, in the Japan Patent Office, the entire disclosure of which is hereby incorporated herein by reference.

FIELD OF THE INVENTION

Example embodiments generally relate to an image forming apparatus and a method for forming a toner image on a recording medium, and more particularly, to an image forming apparatus for forming a toner image on a recording medium and a method used by the image forming apparatus.

BACKGROUND OF THE INVENTION

Related-art image forming apparatuses, such as copiers, facsimile machines, printers, or multifunction printers, having at least one of copying, printing, scanning, and facsimile functions, typically form an image on a recording medium according to image data. Thus, for example, a charger uniformly charges a surface of an image carrier; an optical writer emits a light beam onto the charged surface of the image carrier to form an electrostatic latent image on the image carrier according to the image data; a development device supplies toner to the electrostatic latent image formed on the image carrier to make the electrostatic latent image visible as a toner image; the toner image is directly transferred from the image carrier onto a recording medium or is indirectly transferred from the image carrier onto a recording medium via an intermediate transfer member; a cleaner then collects residual toner not transferred and remaining on the surface of the image carrier after the toner image is transferred from the image carrier onto the recording medium; finally, a fixing device applies heat and pressure to the recording medium bearing the toner image to fix the toner image on the recording medium, thus forming the image on the recording medium.

Typically, the fixing device may include a fixing roller heated by a heater, and a pressing roller pressed against the fixing roller to form a nip therebetween through which the recording medium passes. As a recording medium bearing a toner image passes through the nip, the fixing roller and the pressing roller apply heat and pressure to the recording medium to melt and fix the toner image on the recording medium. Thereafter, the recording medium bearing the fixed toner image is discharged from the nip.

Ordinarily, after finishing one job the fixing device enters a standby state in which the pressing roller remains pressed against the fixing roller while the heater heats the fixing roller to prepare for the next print job. However, if the pressing roller is constantly pressed against the fixing roller, an elastic layer of both the pressing roller and the fixing roller may be deformed permanently into a bow-like shape, generating a gap between the pressing roller and the fixing roller. As a result, the pressing roller and the fixing roller may not convey the recording medium precisely, forming a faulty toner image on the recording medium and generating noise.

To address this problem, the fixing device may further include a moving assembly that moves the pressing roller with respect to the fixing roller so as to alternately press the pressing roller against the fixing roller and separate the pressing roller from the fixing roller. For example, the moving assembly separates the pressing roller from the fixing roller when the image forming apparatus finishes a print job, thus minimizing deformation of the pressing roller and the fixing roller due to pressure therebetween at the nip.

Two control methods are known for control of the moving assembly. A first method is to separate the pressing roller from the fixing roller immediately after a recording medium bearing a fixed toner image is discharged from the nip, minimizing the amount of time the pressing roller presses against the fixing roller. A second method is to separate the pressing roller from the fixing roller when the image forming apparatus does not receive the next print job within a predetermined time period after finishing the previous print job.

The first method has advantages in that the minimized time for which the pressing roller presses against the fixing roller reduces not only deformation of the rollers but also consumption of power because the standby state is omitted. However, the first method has a drawback in that, since the pressing roller separates from the fixing roller whenever the print job is finished, it increases the frequency of separating the pressing roller from the fixing roller, which generates considerable noise due to a spring installed in the moving assembly and generates excess wear on the pressing roller and the fixing roller.

By contrast, the second method has an advantage in that the frequency of separating the pressing roller from the fixing roller is decreased. However, the second method has a drawback in that the pressing roller continues being pressed against the fixing roller while the heater heats the fixing roller for a predetermined time period in the standby state even though the image forming apparatus does not receive the next print job, thus wasting power.

Accordingly, there is a need for a technology that achieves the optimum balance between minimization of noise significant in the first method and minimization of power consumption significant in the second method.

BRIEF SUMMARY OF THE INVENTION

At least one embodiment may provide an image forming apparatus that includes an image forming device to form a toner image on a recording medium according to image data and a fixing device disposed downstream from the image forming device in a recording medium conveyance direction to fix the toner image on the recording medium. The fixing device includes a fixing rotary body rotatable in a predetermined direction of rotation; a pressing rotary body separatably pressed against the fixing rotary body to form a nip therebetween through which the recording medium bearing the toner image passes; and a moving assembly operatively connected to the pressing rotary body to move the pressing rotary body bidirectionally to alternately press the pressing rotary body against the fixing rotary body and separate the pressing rotary body from the fixing rotary body. The image forming apparatus further includes a controller operatively connected to the moving assembly to control the moving assembly to change a post-fixing pressing time period for which the moving assembly presses the pressing rotary body against the fixing rotary body after the recording medium bearing the toner image is discharged from the nip according to the image data.

At least one embodiment may provide a method for forming a toner image on a recording medium performed by an image forming apparatus, that includes steps of powering on the image forming apparatus; warming up the image forming apparatus; identifying image data contained in a print job; forming the toner image on the recording medium according to the identified image data; pressing a pressing rotary body against a fixing rotary body to form a nip therebetween; conveying the recording medium bearing the toner image through the nip to fix the toner image on the recording medium; determining a post-fixing pressing time period for which the pressing rotary body is pressed against the fixing rotary body after the recording medium bearing the toner image is discharged from the nip according to the identified image data; pressing the pressing rotary body against the fixing rotary body for the determined post-fixing pressing time period after the recording medium bearing the toner image is discharged from the nip; separating the pressing rotary body from the fixing rotary body after the determined post-fixing pressing time period elapses; and deactivating software and hardware components installed in the image forming apparatus used for forming the toner image on the recording medium.

Additional features and advantages of example embodiments will be more fully apparent from the following detailed description, the accompanying drawings, and the associated claims.

BRIEF DESCRIPTION OF THE SEVERAL VIEWS OF THE DRAWINGS

A more complete appreciation of example embodiments and the many attendant advantages thereof will be readily obtained as the same becomes better understood by reference to the following detailed description when considered in connection with the accompanying drawings, wherein.

DETAILED DESCRIPTION OF THE INVENTION

Figure 1:
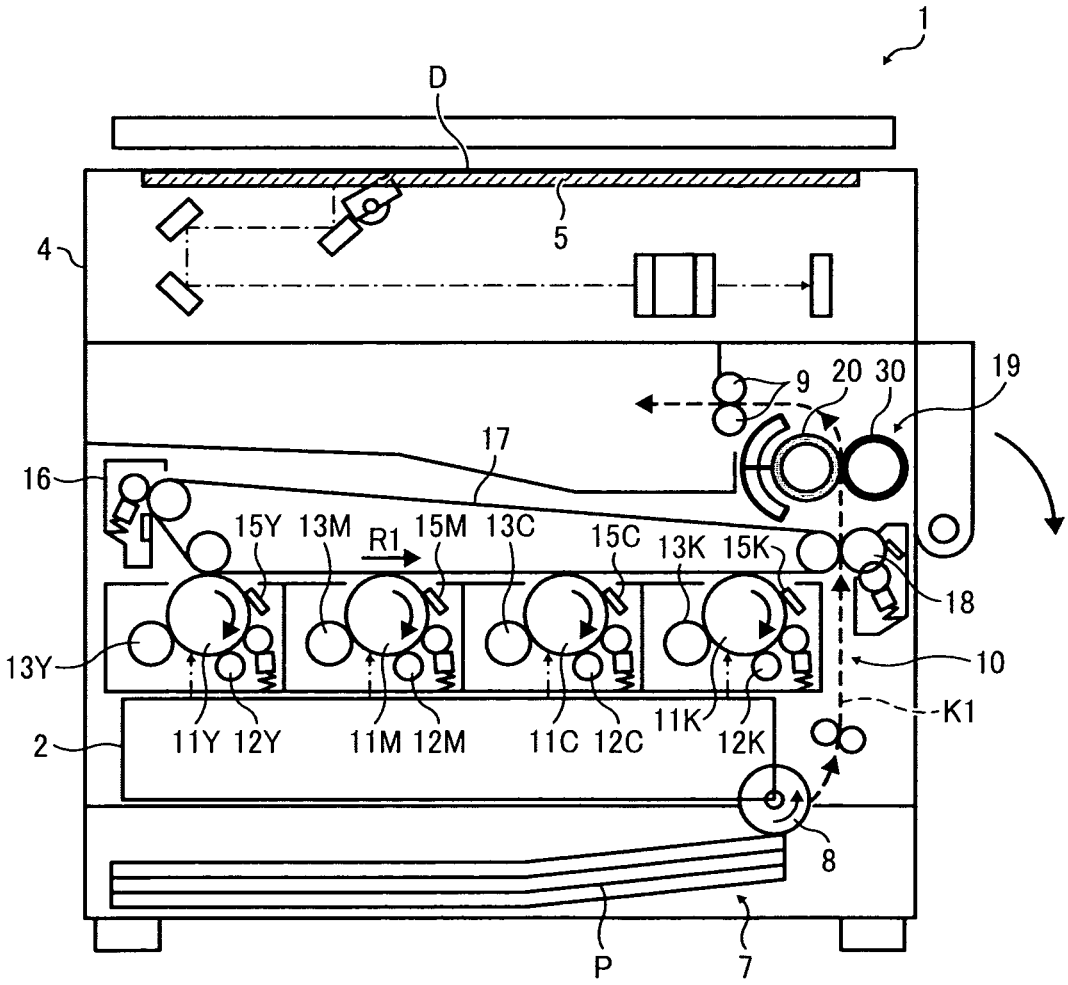
FIG. 1 is a schematic sectional view of an image forming apparatus according to an example embodiment.

It will be understood that if an element or layer is referred to as being "on", "against", "connected to", or "coupled to" another element or layer, then it can be directly on, against, connected or coupled to the other element or layer, or intervening elements or layers may be present. In contrast, if an element is referred to as being "directly on", "directly connected to", or "directly coupled to" another element or layer, then there are no intervening elements or layers present. Like numbers refer to like elements throughout. As used herein, the term "and/or" includes any and all combinations of one or more of the associated listed items.

Spatially relative terms, such as "beneath", "below", "lower", "above", "upper", and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors used herein are interpreted accordingly.

Although the terms first, second, etc. may be used herein to describe various elements, components, regions, layers and/or sections, it should be understood that these elements, components, regions, layers and/or sections should not be limited by these terms. These terms are used only to distinguish one element, component, region, layer, or section from another region, layer, or section. Thus, a first element, component, region, layer, or section discussed below could be termed a second element, component, region, layer, or section without departing from the teachings of the present invention.

The terminology used herein is for the purpose of describing particular embodiments only and is not intended to be limiting of the present invention. As used herein, the singular forms "a", "an", and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

In describing example embodiments illustrated in the drawings, specific terminology is employed for the sake of clarity. However, the disclosure of this specification is not intended to be limited to the specific terminology so selected and it is to be understood that each specific element includes all technical equivalents that operate in a similar manner and achieve a similar result.

Referring now to the drawings, wherein like reference numerals designate identical or corresponding parts throughout the several views, particularly to FIG. 1, an image forming apparatus 1 according to an example embodiment is explained.

FIG. 1 is a schematic sectional view of the image forming apparatus 1. As illustrated in FIG. 1, the image forming apparatus 1 may be a copier, a facsimile machine, a printer, a multifunction printer having at least one of copying, printing, scanning, plotter, and facsimile functions, or the like. According to this example embodiment, the image forming apparatus 1 is a multifunction printer for forming a monochrome image and a color image on a recording medium by electrophotography.

Referring to FIG. 1, the following describes the structure of the image forming apparatus 1.

As illustrated in FIG. 1, the image forming apparatus 1 includes an original document reader 4 disposed in an upper portion of the image forming apparatus 1 and including an exposure glass 5. The original document reader 4 reads an image on an original document D placed on the exposure glass 5 and generates image data. Below the original document reader 4 is an image forming device 10 that includes a writer 2, photoconductive drums 11Y, 11M, 11C, and 11K, chargers 12Y, 12M, 12C, and 12K, development devices 13Y, 13M, 13C, and 13K, cleaners 15Y, 15M, 15C, and 15K, an intermediate transfer belt cleaner 16, an intermediate transfer belt 17, and a second transfer roller 18. For example, in a lower portion of the image forming apparatus 1 is the writer 2 that emits laser beams onto the photoconductive drums 11Y, 11M, 11C, and 11K surrounded by the chargers 12Y, 12M, 12C, and 12K, the development devices 13Y, 13M, 13C, and 13K, and the cleaners 15Y, 15M, 15C, and 15K, respectively. Specifically, the writer 2 emits the laser beams onto the photoconductive drums 11Y, 11M, 11C, and 11K charged by the chargers 12Y, 12M, 12C, and 12K according to the image data sent from the original document reader 4, thus forming electrostatic latent images on the photoconductive drums 11Y, 11M, 11C, and 11K. The development devices 13Y, 13M, 13C, and 13K visualize the electrostatic latent images formed on the photoconductive drums 11Y, 11M, 11C, and 11K with yellow, magenta, cyan, and black toners into yellow, magenta, cyan, and black toner images, respectively. The photoconductive drums 11Y, 11M, 11C, and 11K are disposed opposite transfer bias rollers that transfer the yellow, magenta, cyan, and black toner images from the photoconductive drums 11Y, 11M, 11C, and 11K onto the intermediate transfer belt 17 in such a manner that the yellow, magenta, cyan, and black toner images are superimposed on the same position on the intermediate transfer belt 17, thus producing a color toner image on the intermediate transfer belt 17. After the transfer of the yellow, magenta, cyan, and black toner images, the cleaners 15Y, 15M, 15C, and 15K collect residual toners from the photoconductive drums 11Y, 11M, 11C, and 11K, respectively. Specifically, the intermediate transfer belt 17, looped over the transfer bias rollers and other rollers including a driving roller, rotates in a rotation direction R1. Below the writer 2 is a paper tray 7 that contains a plurality of recording media P (e.g., transfer sheets). Above the paper tray 7 is a feed roller 8 that picks up and feeds a recording medium P from the paper tray 7 to a registration roller pair that feeds the recording medium P to a second transfer nip formed between the intermediate transfer belt 17 and the second transfer roller 18 at a proper time. As the recording medium P is conveyed through the second transfer nip, the second transfer roller 18 transfers the color toner image from the intermediate transfer belt 17 onto the recording medium P.

After the transfer of the color toner image from the intermediate transfer belt 17, the intermediate transfer belt cleaner 16 disposed opposite the intermediate transfer belt 17 cleans the intermediate transfer belt 17. Above the second transfer roller 18 is a fixing device 19 that fixes the color toner image on the recording medium P by heating the recording medium P by electromagnetic induction. Above the fixing device 19 is an output roller pair 9 that discharges the recording medium P bearing the fixed color toner image sent from the fixing device 19 to an outside of the image forming apparatus 1.

Referring to FIG. 1, the following describes the operation of the image forming apparatus 1 having the above-described structure to form a color toner image on a recording medium P.

The original document reader 4 optically reads an image on the original document D placed on the exposure glass 5. For example, a lamp of the original document reader 4 emits a light beam onto the original document D bearing the image. The light beam reflected by the original document D travels to a color sensor through mirrors and a lens, where the image is formed. The color sensor reads and separates the image into red, green, and blue images, and converts the images into electric image signals for red, green, and blue. Based on the respective electric image signals, an image processor of the original document reader 4 performs processing such as color conversion, color correction, and space frequency correction, thus producing yellow, magenta, cyan, and black image data.

Thereafter, the yellow, magenta, cyan, and black image data are sent to the writer 2. The writer 2 emits laser beams onto the photoconductive drums 11Y, 11M, 11C, and 11K according to the yellow, magenta, cyan, and black image data sent from the original document reader 4.

A detailed description is now given of five processes performed on the photoconductive drums 11Y, 11M, 11C, and 11K, that is, a charging process, an exposure process, a development process, a first transfer process, and a cleaning process.

The four photoconductive drums 11Y, 11M, 11C, and 11K rotate clockwise in FIG. 1. In the charging process, the chargers 12Y, 12M, 12C, and 12K, disposed opposite the photoconductive drums 11Y, 11M, 11C, and 11K, uniformly charge an outer circumferential surface of the respective photoconductive drums 11Y, 11M, 11C, and 11K, thus generating a charging potential on the respective photoconductive drums 11Y, 11M, 11C, and 11K. Thereafter, the charged outer circumferential surface of the respective photoconductive drums 11Y, 11M, 11C, and 11K reaches a position where it receives a laser beam.

In the exposure process, four light sources of the writer 2, disposed opposite the photoconductive drums 11Y, 11M, 11C, and 11K, emit laser beams according to the yellow, magenta, cyan, and black image data, respectively. The laser beams corresponding to the yellow, magenta, cyan, and black image data travel through different optical paths, respectively. For example, the laser beam corresponding to the yellow image data irradiates the leftmost photoconductive drum 11Y in FIG. 1. Specifically, a polygon mirror of the writer 2, which rotates at a high speed, causes the laser beam corresponding to the yellow image data to scan the charged surface of the photoconductive drum 11Y in an axial direction of the photoconductive drum 11Y, that is, a main scanning direction. Thus, an electrostatic latent image is formed on the surface of the photoconductive drum 11Y charged by the charger 12Y according to the yellow image data.

Similarly, the laser beam corresponding to the magenta image data irradiates the second photoconductive drum 11M from the left in FIG. 1, forming an electrostatic latent image according to the magenta image data. The laser beam corresponding to the cyan image data irradiates the third photoconductive drum 11C from the left in FIG. 1, forming an electrostatic latent image according to the cyan image data. The laser beam corresponding to the black image data irradiates the rightmost photoconductive drum 11K in FIG. 1, forming an electrostatic latent image according to the black image data.

Thereafter, the outer circumferential surface of the respective photoconductive drums 11Y, 11M, 11C, and 11K formed with the electrostatic latent images reaches a position where the photoconductive drums 11Y, 11M, 11C, and 11K are disposed opposite the development devices 13Y, 13M, 13C, and 13K, respectively. In the development process, the development devices 13Y, 13M, 13C, and 13K, disposed opposite the photoconductive drums 11Y, 11M, 11C, and 11K, supply yellow, magenta, cyan, and black toners to the electrostatic latent images formed on the photoconductive drums 11Y, 11M, 11C, and 11K, respectively, thus rendering the electrostatic latent images visible as yellow, magenta, cyan, and black toner images.

Thereafter, the outer circumferential surface of the respective photoconductive drums 11Y, 11M, 11C, and 11K formed with the yellow, magenta, cyan, and black toner images reaches a position where the photoconductive drums 11Y, 11M, 11C, and 11K are disposed opposite the intermediate transfer belt 17. The four transfer bias rollers are disposed opposite the four photoconductive drums 11Y, 11M, 11C, and 11K, respectively, via the intermediate transfer belt 17 in a state in which the transfer bias rollers contact an inner circumferential surface of the intermediate transfer belt 17. In the first transfer process, the transfer bias rollers transfer the yellow, magenta, cyan, and black toner images from the photoconductive drums 11Y, 11M, 11C, and 11K onto an outer circumferential surface of the intermediate transfer belt 17 successively in such a manner that the yellow, magenta, cyan, and black toner images are superimposed on the same position on the intermediate transfer belt 17, thus producing a color toner image on the intermediate transfer belt 17.

Thereafter, the outer circumferential surface of the respective photoconductive drums 11Y, 11M, 11C, and 11K that no longer carry the yellow, magenta, cyan, and black toner images reaches a position where the photoconductive drums 11Y, 11M, 11C, and 11K are disposed opposite the cleaners 15Y, 15M, 15C, and 15K, respectively. In the cleaning process, the cleaners 15Y, 15M, 15C, and 15K, disposed opposite the photoconductive drums 11Y, 11M, 11C, and 11K, collect residual toners not transferred and therefore remaining on the photoconductive drums 11Y, 11M, 11C, and 11K from the photoconductive drums 11Y, 11M, 11C, and 11K, respectively.

Thereafter, dischargers disposed opposite the photoconductive drums 11Y, 11M, 11C, and 11K discharge the outer circumferential surface of the respective photoconductive drums 11Y, 11M, 11C, and 11K, thus completing a series of processes performed on the photoconductive drums 11Y, 11M, 11C, and 11K.

A detailed description is now given of two processes performed on the intermediate transfer belt 17, that is, a second transfer process and a cleaning process.

The outer circumferential surface of the intermediate transfer belt 17 transferred with the color toner image reaches a position where it is disposed opposite the second transfer roller 18, that is, the second transfer nip. Specifically, the second transfer nip is created by the second transfer roller 18 and a second transfer backup roller that sandwich the intermediate transfer belt 17. As a recording medium P sent from the paper tray 7 passes through the second transfer nip, the color toner image formed on the intermediate transfer belt 17 is transferred onto the recording medium P in the second transfer process. After the transfer of the color toner image from the intermediate transfer belt 17, residual toner not transferred onto the recording medium P remains on the intermediate transfer belt 17.

Thereafter, the outer circumferential surface of the intermediate transfer belt 17 that no longer carries the color toner image reaches a position where it is disposed opposite the intermediate transfer belt cleaner 16. The intermediate transfer belt cleaner 16 collects the residual toner from the intermediate transfer belt 17 in the cleaning process, thus completing a series of processes performed on the intermediate transfer belt 17.

A detailed description is now given of two processes performed on the recording medium P, that is, the second transfer process described above and a fixing process.

The recording medium P is conveyed from the paper tray 7 disposed in the lower portion of the image forming apparatus 1 to the second transfer nip through a conveyance path K1 provided with the feed roller 8 and the registration roller pair. For example, the paper tray 7 contains a plurality of recording media P. As the feed roller 8 rotates counterclockwise in FIG. 1, the feed roller 8 feeds an uppermost recording medium P to the conveyance path K1.

The recording medium P conveyed to the conveyance path K1 is stopped temporarily by the registration roller pair at a nip formed between two rollers of the registration roller pair. When the registration roller pair resumes rotating, the registration roller pair feeds the recording medium P to the second transfer nip at a proper time for transferring the color toner image formed on the intermediate transfer belt 17 onto the recording medium P. Thus, a desired color toner image is transferred onto the recording medium P in the second transfer process described above.

Thereafter, the recording medium P bearing the color toner image is sent to the fixing device 19 where a fixing roller 20 and a pressing roller 30 apply heat and pressure to the recording medium P to fix the color toner image on the recording medium P in the fixing process. Then, the output roller pair 9 disposed downstream from the fixing device 19 in a conveyance direction of the recording medium P discharges the recording medium P bearing the fixed color toner image in a direction indicated by the broken line arrow onto the outside of the image forming apparatus 1, thus completing a series of processes for forming the color toner image on the recording medium P.

Figure 2:
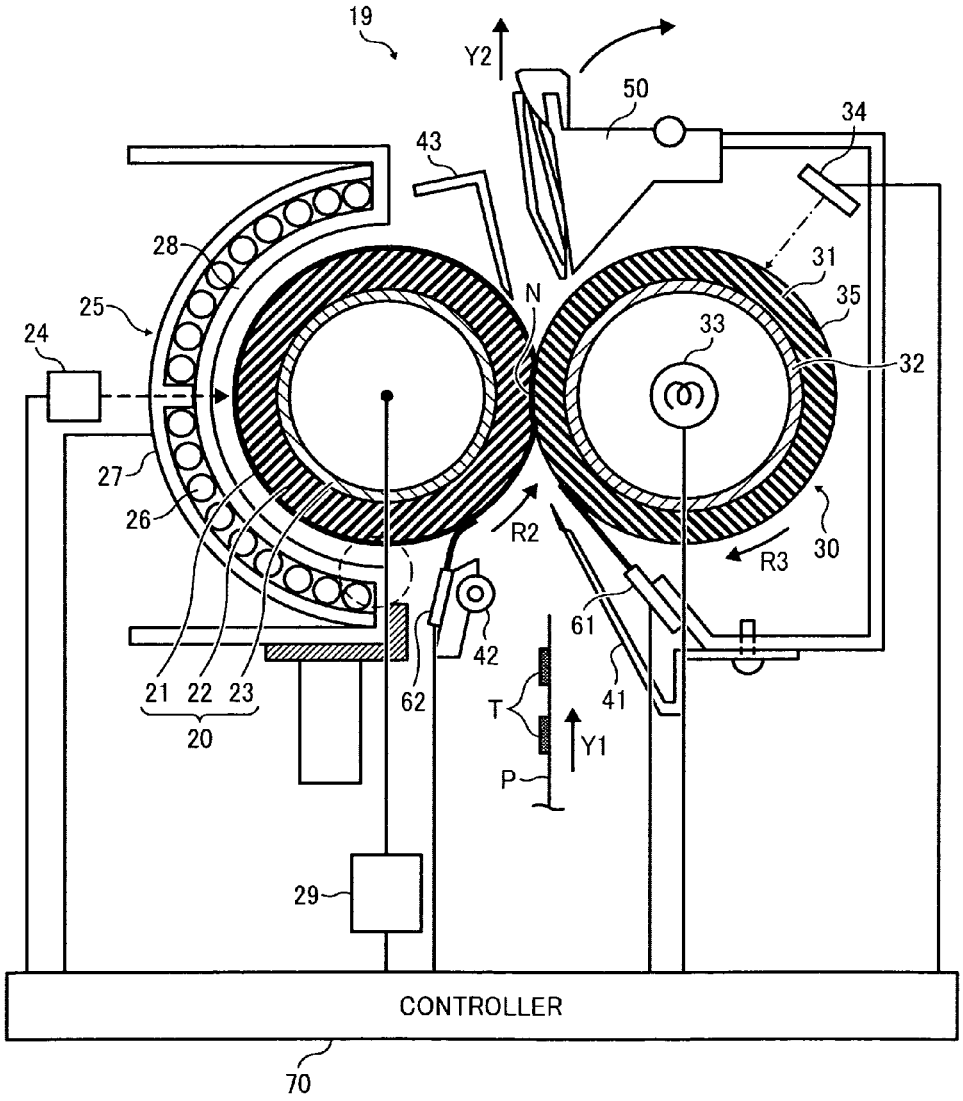
FIG. 2 is a vertical sectional view of a fixing device installed in the image forming apparatus shown in FIG. 1.
Figure 3:
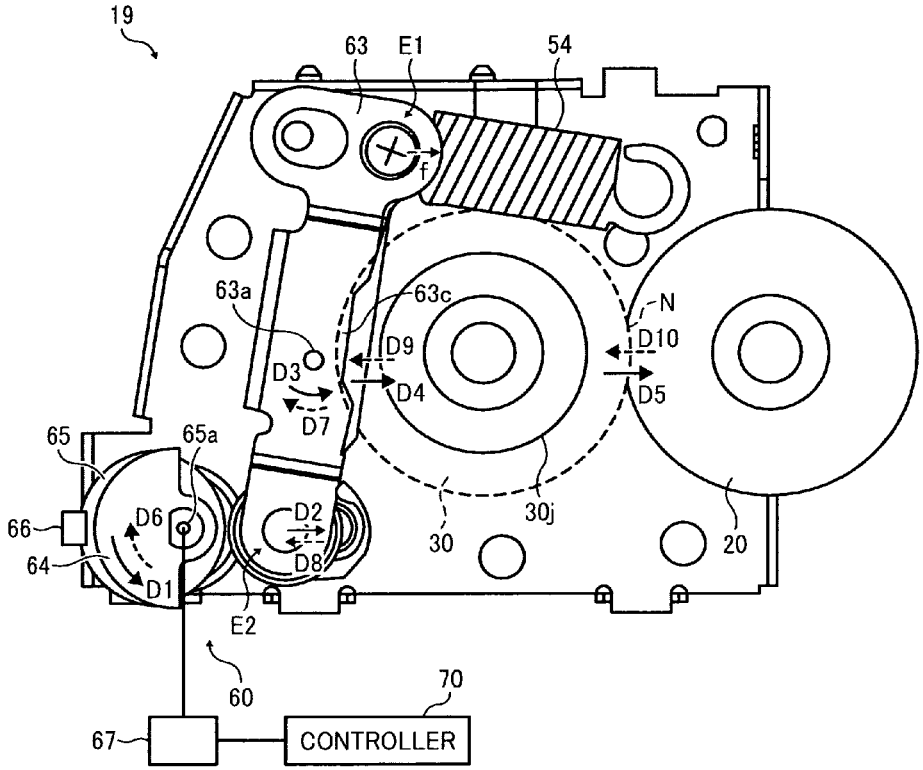
FIG. 3 is a vertical sectional view of the fixing device shown in FIG. 2.

Referring to FIGS. 2 and 3, the following describes the structure and operation of the fixing device 19 installed in the image forming apparatus 1 described above.

FIG. 2 is a vertical sectional view of the fixing device 19. FIG. 3 is a vertical sectional view of the fixing device 19. As illustrated in FIG. 2, the fixing device 19 (e.g., a fuser unit) includes the fixing roller 20 serving as a fixing rotary body; the pressing roller 30 serving as a pressing rotary body pressed against the fixing roller 20 to form a fixing nip N therebetween through which a recording medium P bearing a toner image T passes; an induction heater 25 serving as a magnetic flux generator or a heater disposed opposite the fixing roller 20; an entrance guide 41 (e.g., a plate) disposed upstream from the fixing nip N in the conveyance direction of the recording medium P; a spur guide 42 (e.g., a plate) disposed opposite the entrance guide 41 and upstream from the fixing nip N in the conveyance direction of the recording medium P; a separation guide 43 (e.g., a plate) disposed downstream from the fixing nip N in the conveyance direction of the recording medium P; an exit guide 50 (e.g., a plate) disposed opposite the separation guide 43 and downstream from the fixing nip N in the conveyance direction of the recording medium P; a thermistor 61 disposed upstream from the fixing nip N in the conveyance direction of the recording medium P and contacting the pressing roller 30; and a thermistor 62 disposed upstream from the fixing nip N in the conveyance direction of the recording medium P and contacting the fixing roller 20.

A detailed description is now given of the fixing roller 20.

The fixing roller 20 having an outer diameter of about 40 mm is constructed of three layers: a metal core 23 made of iron, stainless steel, or the like; a heat insulating elastic layer 22 disposed on the metal core 23 and made of silicone rubber foam or the like; and a sleeve layer 21 disposed on the heat insulating elastic layer 22.

The sleeve layer 21 has a multilayer structure constructed of a base layer constituting an inner circumferential surface, a first antioxidant layer disposed on the base layer, a heat generating layer disposed on the first antioxidant layer, a second antioxidant layer disposed on the heat generating layer, an elastic layer disposed on the second antioxidant layer, and a release layer disposed on the elastic layer. For example, the base layer having a thickness of about 40 micrometers is made of stainless steel or the like. The first antioxidant layer and the second antioxidant layer are treated with nickel strike plating with a thickness of about 1 micrometer or smaller. The heat generating layer having a thickness of about 10 micrometers is made of copper or the like. The elastic layer having a thickness of about 150 micrometers is made of silicone rubber or the like. The release layer having a thickness of about 30 micrometers is made of tetrafluoroethylene-perfluoroalkylvinylether copolymer (PFA) or the like.

With the above-described structure, the heat generating layer of the sleeve layer 21 of the fixing roller 20 is heated by electromagnetic induction by a magnetic flux generated by the induction heater 25. It is to be noted that the structure of the fixing roller 20 is not limited to the above. For example, the sleeve layer 21 may be separately provided from the heat insulating elastic layer 22 by not being adhered to the heat insulating elastic layer 22. In this case, the sleeve layer 21 serves as a fixing sleeve and the heat insulating elastic layer 22 serves as a supplemental fixing roller. Further, it is preferable that the fixing roller 20 may further include a mechanism that prevents the sleeve layer 21 from shifting from the heat insulating elastic layer 22 in an axial direction, that is, a thrust direction, of the fixing roller 20 as the fixing roller 20 rotates.

A detailed description is now given of the components surrounding the fixing roller 20.

The spur guide 42 is disposed opposite the fixing roller 20 and upstream from the fixing nip N in the conveyance direction of the recording medium P. The spur guide 42 includes a plurality of spurs arranged in the axial direction of the fixing roller 20. The spur guide 42 is disposed opposite an image side (e.g., a front side) of the recording medium P bearing the unfixed toner image T conveyed toward the fixing nip N, guiding the recording medium P to the fixing nip N. The plurality of spurs of the spur guide 42 has a sawtooth circumferential surface portion to prevent the plurality of spurs from scratching and damaging the unfixed toner image T on the recording medium P when the plurality of spurs contacts the image side of the recording medium P.

The separation guide 43 is disposed opposite the fixing roller 20 and downstream from the fixing nip N in the conveyance direction of the recording medium P. The separation guide 43 is disposed opposite the image side of the recording medium P conveyed from the fixing nip N. The separation guide 43 prevents the recording medium P bearing the fixed toner image T from being attracted and adhered to the fixing roller 20 as the recording medium P is discharged from the fixing nip N. For example, the separation guide 43 contacts a leading edge of the recording medium P and separates the recording medium P from the fixing roller 20.

The thermistor 62 is disposed in proximity to the fixing nip N and upstream from the fixing nip N in the conveyance direction of the recording medium P. The thermistor 62 serving as a contact temperature detecting sensor contacts the fixing roller 20 at one lateral end of the fixing roller 20 in the axial direction thereof where the fixing roller 20 is driven, thus detecting a surface temperature of the fixing roller 20.

A thermopile 24 serving as a non-contact temperature detecting sensor is disposed opposite the fixing roller 20 at a center of the fixing roller 20 in the axial direction thereof. A thermopile is an element that detects a temperature of an object based on infrared rays radiated from the object. For example, the infrared rays radiated from the object are absorbed by a thermal conversion film disposed inside the thermopile and converted into heat. Thereafter, lots of small thermocouples disposed on the thermal conversion film detect the heat as a temperature.

The thermistor 62 and the thermopile 24 described above detect the temperature of the fixing roller 20, that is, a fixing temperature at which the toner image T is fixed on the recording medium P. The thermistor 62 and the thermopile 24 are operatively connected to a controller 70, that is, a central processing unit (CPU) provided with a random-access memory (RAM) and a read-only memory (ROM), for example. The controller 70 is operatively connected to the induction heater 25 to control the induction heater 25 to adjust a heating amount of the induction heater 25 that heats the fixing roller 20 based on the temperature of the fixing roller 20 detected by the thermistor 62 and the thermopile 24. According to this example embodiment, the controller 70 controls the induction heater 25 to heat the fixing roller 20 to the temperature in a range of from about 160 degrees centigrade to about 165 degrees centigrade during the fixing process, that is, when the recording medium P bearing the toner image T passes through the fixing nip N.

As shown in FIG. 2, the pressing roller 30 is constructed of three layers: a cylindrical core 32 made of steel, aluminum, or the like; an elastic layer 31 disposed on the core 32 and made of silicone rubber or the like; and a release layer 35 disposed on the elastic layer 31 and made of PFA or the like. The elastic layer 31 has a thickness in a range of from about 1 mm to about 5 mm. The release layer 35 has a thickness in a range of from about 20 micrometers to about 200 micrometers.

As shown in FIG. 3, the fixing device 19 further includes a moving assembly 60 that presses the pressing roller 30 against the fixing roller 20 to form the fixing nip N therebetween through which the recording medium P bearing the toner image T passes, a detailed description of the moving assembly 60 is deferred.

According to this example embodiment shown in FIG. 2, a heater 33 (e.g., a halogen heater) is disposed inside the pressing roller 30 to heat the fixing roller 20 more effectively. For example, when power is supplied to the heater 33, the heater 33 emits light and radiation heat to heat the pressing roller 30. Then, the pressing roller 30 heats the fixing roller 20.

A detailed description is now given of the components surrounding the pressing roller 30.

The thermistor 61 is disposed upstream from the fixing nip N in the conveyance direction of the recording medium P and in proximity to the fixing nip N. The thermistor 61 serves as a contact temperature detecting sensor that contacts the pressing roller 30 at one lateral end of the pressing roller 30 in an axial direction thereof where the pressing roller 30 is driven, thus detecting a surface temperature of the pressing roller 30.

A thermopile 34 is disposed opposite the pressing roller 30 at a center of the pressing roller 30 in the axial direction thereof and serves as a non-contact temperature detecting sensor that detects the temperature of the pressing roller 30 without contacting the pressing roller 30.

The thermistor 61 and the thermopile 34 described above detect the temperature of the pressing roller 30. The thermistor 61 and the thermopile 34 are operatively connected to the controller 70 that is operatively connected to the heater 33 to control the heater 33 to adjust a heating amount of the heater 33 that heats the pressing roller 30 based on the temperature of the pressing roller 30 detected by the thermistor 61 and the thermopile 34.

The entry guide 41 is disposed upstream from the fixing nip N in the conveyance direction of the recording medium P. The entry guide 41 is disposed opposite the pressing roller 30 and a non-image side (e.g., a back side) of the recording medium P not bearing the unfixed toner image T conveyed toward the fixing nip N, thus guiding the recording medium P to the fixing nip N. It is to be noted that the non-image side of the recording medium P defines a side of the recording medium P that bears no toner image or bears the fixed toner image in duplex printing.

The exit guide 50 is disposed downstream from the fixing nip N in the conveyance direction of the recording medium P. The exit guide 50 is disposed opposite the pressing roller 30 and the non-image side of the recording medium P discharged from the fixing nip N, thus guiding the recording medium P bearing the fixed toner image T discharged from the fixing nip N to a conveyance path disposed downstream from the fixing device 19 in the conveyance direction of the recording medium P.

A detailed description is now given of the induction heater 25.

The induction heater 25 is disposed opposite the fixing roller 20 at a face of the fixing roller 20 opposite a face thereof where the pressing roller 30 is disposed opposite the fixing roller 20. The induction heater 25 includes a coil 26 (e.g., an exciting coil), a core 27 (e.g., an exciting coil core), and a coil guide 28.

The coil 26 includes litz wire made of bundled thin wire wound around the coil guide 28 that covers a part of an outer circumferential surface of the fixing roller 20 and extending in the axial direction of the fixing roller 20.

The coil guide 28 is made of a heat resistant resin such as polyethylene-terephthalate (PET) that contains glass at a rate of about 45 percent. The coil guide 28 is disposed opposite the fixing roller 20 to hold the coil 26 with respect to the outer circumferential surface of the fixing roller 20. According to this example embodiment, a gap in a range of from about 1.9 mm to about 2.1 mm is provided between the outer circumferential surface of the fixing roller 20 and an inner circumferential surface of the coil guide 28 that faces the outer circumferential surface of the fixing roller 20.

The core 27 is made of ferromagnet such as ferrite having a magnetic permeability of about 2, 500 and includes an arc core, a center core, and a side core to generate magnetic fluxes toward the heat generating layer of the fixing roller 20 effectively.

Referring to FIG. 2, the following describes the operation of the fixing device 19 having the above-described structure.

A driver 29 (e.g., a motor) drives and rotates the fixing roller 20 counterclockwise in FIG. 2 in a rotation direction R2. The rotating fixing roller 20 rotates the pressing roller 30 clockwise in FIG. 2 in a rotation direction R3 counter to the rotation direction R2 of the fixing roller 20. The induction heater 25 disposed opposite the fixing roller 20 generates a magnetic flux to heat the heat generating layer of the sleeve layer 21 of the fixing roller 20.

For example, a frequency variable power supply of an oscillator circuit sends a high frequency alternating current in a range of from about 10 kHz to about 1 MHz, preferably in a range of from about 20 kHz to about 800 kHz, to the coil 26. Accordingly, the coil 26 generates magnetic lines of force alternately switched bidirectionally toward the sleeve layer 21 of the fixing roller 20, thus generating an alternating magnetic field. The alternating magnetic field generates an eddy current in the heat generating layer of the sleeve layer 21, which causes the heat generating layer to generate Joule heat by its electric resistance. Thus, the sleeve layer 21 heats itself by induction heating of the heat generating layer thereof.

Thereafter, as the fixing roller 20 rotates, a portion of the outer circumferential surface of the fixing roller 20 heated by the induction heater 25 reaches the fixing nip N formed between the fixing roller 20 and the pressing roller 30 contacting each other.

Accordingly, the fixing roller 20 heats and melts the toner image T on the recording medium P conveyed through the fixing nip N.

For example, the recording medium P bearing the toner image T formed by the above-described image forming processes is conveyed in a direction Y1 to the fixing nip N while guided by the entry guide 41 or the spur guide 42. As the recording medium P bearing the toner image T passes through the fixing nip N, the heated portion of the fixing roller 20 heats the recording medium P and at the same time the pressing roller 30 applies pressure to the recording medium P, thus melting and fixing the toner image T on the recording medium P. Then, the recording medium P is discharged from the fixing nip N and is conveyed in a direction Y2. After the recording medium P bearing the fixed toner image T is discharged from the fixing nip N, the heated portion of the fixing roller 20 having passed through the fixing nip N and now cooled by the recording medium P returns to an opposed position where the fixing roller 20 is disposed opposite the induction heater 25.

Referring to FIG. 3, the following describes the moving assembly 60 that moves the pressing roller 30 toward and away from the fixing roller 20.

FIG. 3 is a vertical sectional view of the fixing device 19 including the moving assembly 60. The sectional view of FIG. 3 is seen from one axial end of the fixing roller 20 opposite another axial end of the fixing roller 20 from which the sectional view of FIG. 2 is seen.

As illustrated in FIG. 3, the moving assembly 60 includes an arm 63, a biasing member 54 (e.g., a spring), a cam 65, a feeler 64, and a photo sensor 66. The arm 63 is rotatable about a support shaft 63*a* to contact and separate from a roller shaft 30*j* of the pressing roller 30. One end of the biasing member 54 in a longitudinal direction thereof is mounted on one end, that is, a first end E1, of the arm 63 in a longitudinal direction thereof; another end of the biasing member 54 is mounted on a side plate of the fixing device 19. The cam 65 is rotated by a driving force generated by an actuator 67 and pressed against another end, that is, a second end E2, of the arm 63 in the longitudinal direction thereof. The feeler 64 is a disciform encoder that rotates in accordance with rotation of the cam 65. The photo sensor 66 detects a position of the rotating feeler 64.

As the biasing member 54 exerts a bias f to the first end E1 of the arm 63, the arm 63 rotates about the support shaft 63*a* in a direction D7 in which the arm 63 moves away from the roller shaft 30*j* of the pressing roller 30. By contrast, the cam 65 exerts pressure to the second end E2 of the arm 63 to rotate the arm 63 in a direction D3 counter to the direction D7 against the bias f exerted by the biasing member 54.

The pressure exerted by the cam 65 to the arm 63 is variable according to a phase of the cam 65, switching the arm 63 between a pressing state in which the arm 63 presses against the pressing roller 30 to apply pressure to the fixing nip N and a pressure release state in which the arm 63 does not press against the pressing roller 30 to release pressure at the fixing nip N.

Referring to FIG. 3, the following describes the operations of the moving assembly 60, that is, a pressing operation to press the pressing roller 30 against the fixing roller 20 by moving the pressing roller 30 toward the fixing roller 20 and a pressure release operation to separate the pressing roller 30 from the fixing roller 20 by moving the pressing roller 30 away from the fixing roller 20.

A detailed description is now given of the pressing operation of the moving assembly 60.

When power is supplied to the actuator 67 connected to the cam 65, the actuator 67 transmits a driving force to a drive shaft 65*a* of the cam 65. As the drive shaft 65*a* of the cam 65 rotates, the cam 65 rotates counterclockwise by a given rotation angle in a direction D1 and presses against the second end E2 of the arm 63 in a direction D2. For example, pressure exerted by the cam 65 on the second end E2 of the arm 63 is greater than the bias f exerted by the biasing member 54 on the first end E1 of the arm 63. As the cam 65 presses against the second end E2 of the arm 63, the arm 63 rotates about the support shaft 63*a* counterclockwise in FIG. 3 in the direction D3. Accordingly, a center portion 63*c* of the arm 63 in the longitudinal direction thereof contacts and presses against the roller shaft 30*j* of the pressing roller 30 toward the fixing roller 20 in a direction D4. Consequently, the pressing roller 30 contacts and presses against the fixing roller 20 with a given pressure in a direction D5, thus forming the fixing nip N between the pressing roller 30 and the fixing roller 20.

When the fixing device 19 is driven to perform the fixing process as a part of the image forming processes described above, the moving assembly 60 presses the pressing roller 30 against the fixing roller 20 with the given pressure in the pressing state. The pressing state continues as long as power is supplied to the actuator 67.

A detailed description is now given of the pressure release operation of the moving assembly 60.

As the cam 65 pressing the second end E2 of the arm 63 rotates by a given rotation angle clockwise in a direction D6 from the pressing state described above, the pressure applied by the cam 65 to the second end E2 of the arm 63 is released. Simultaneously, the second end E2 of the arm 63 moves in a direction D8. As the pressure applied by the cam 65 on the second end E2 of the arm 63 is released, the bias f of the biasing member 54 rotates the arm 63 about the support shaft 63*a* clockwise in FIG. 3 in the direction D7. Accordingly, the pressure applied by the center portion 63*c* of the arm 63 on the roller shaft 30*j* of the pressing roller 30 is released, moving the pressing roller 30 away from the fixing roller 20 in a direction D9. Consequently, the pressing roller 30 separates from the fixing roller 20 in a direction D10, releasing the pressure applied by the pressing roller 30 to the fixing roller 20 at the fixing nip N.

With the above-described configuration of the moving assembly 60, before the image forming apparatus 1 depicted in FIG. 1 enters a sleep mode in which software and hardware components used for image formation are deactivated, the moving assembly 60 separates the pressing roller 30 from the fixing roller 20 to release the pressure applied at the fixing nip N.

The photo sensor 66 reads the rotation position of the feeler 64 to detect the phase of the cam 65, thus detecting in which state the pressing roller 30 is, that is, the pressing state in which the pressing roller 30 presses against the fixing roller 20 or the pressure release state in which the pressing roller 30 is isolated from the fixing roller 20. Accordingly, the controller 70 controls the actuator 67 that drives the cam 65 to stop at various positions based on the phase of the cam 65 detected by the photo sensor 66, that is, a pressing position where the actuator 67 causes the pressing roller 30 to press against the fixing roller 20 and a pressure release position where the actuator 67 causes the pressing roller 30 to separate from the fixing roller 20.

Figures 4A, 4B, 4C, 4D:
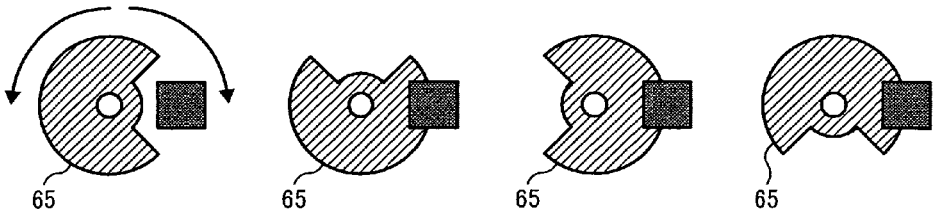
FIG. 4A is a vertical sectional view of a cam of the fixing device shown in FIG. 3 at a pressure release position.
FIG. 4B is a vertical sectional view of the cam shown in FIG. 4A at a first pressing position.
FIG. 4C is a vertical sectional view of the cam shown in FIG. 4A at a second pressing position.
FIG. 4D is a vertical sectional view of the cam shown in FIG. 4A at a third pressing position.

As the pressing position, various pressing positions can be set to cause the pressing roller 30 to press against the fixing roller 20 with various levels of pressure. For example, the cam 65 stops at four positions as shown in FIGS. 4A, 4B, 4C, and 4D. FIG. 4A is a vertical sectional view of the cam 65 at the pressure release position. FIG. 4B is a vertical sectional view of the cam 65 at a first pressing position. FIG. 4C is a vertical sectional view of the cam 65 at a second pressing position. FIG. 4D is a vertical sectional view of the cam 65 at a third pressing position. The cam 65 that stops at the three different pressing positions shown in FIGS. 4B, 4C, and 4D can press the pressing roller 30 against the fixing roller 20 with three different levels of pressure corresponding to the thickness and type of the recording medium P passing through the fixing nip N.

Figure 5A:
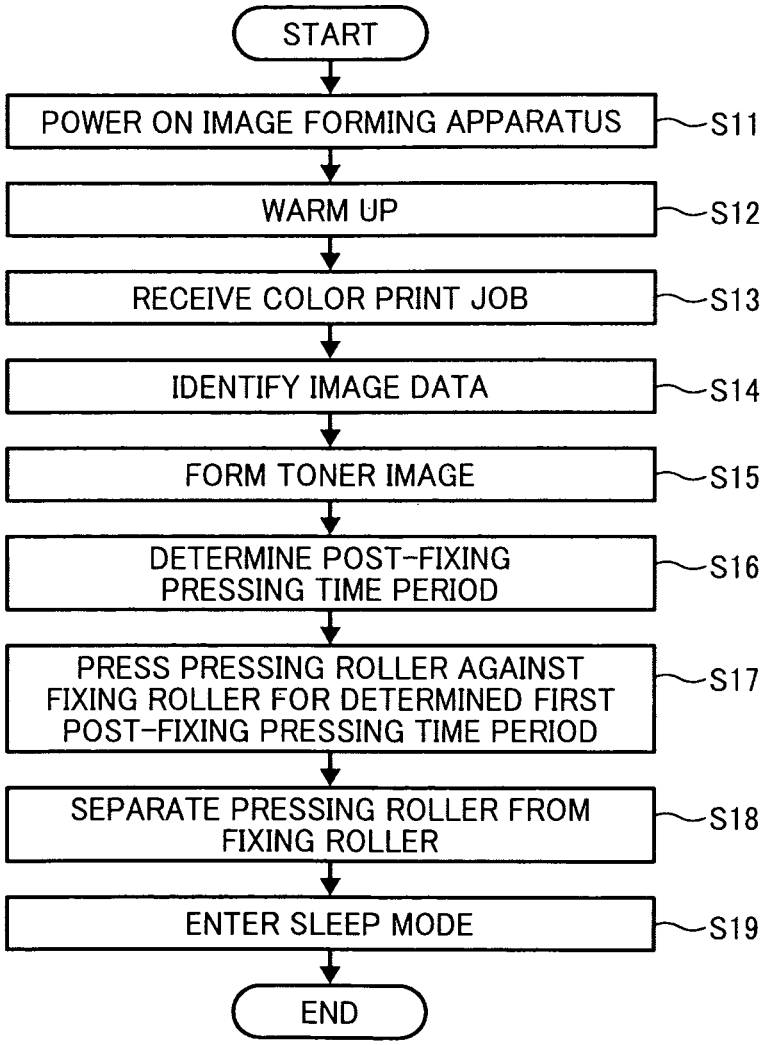
FIG. 5A is a flowchart showing control processes performed by the image forming apparatus shown in FIG. 1 to form a color toner image on a recording medium.
Figure 5B:
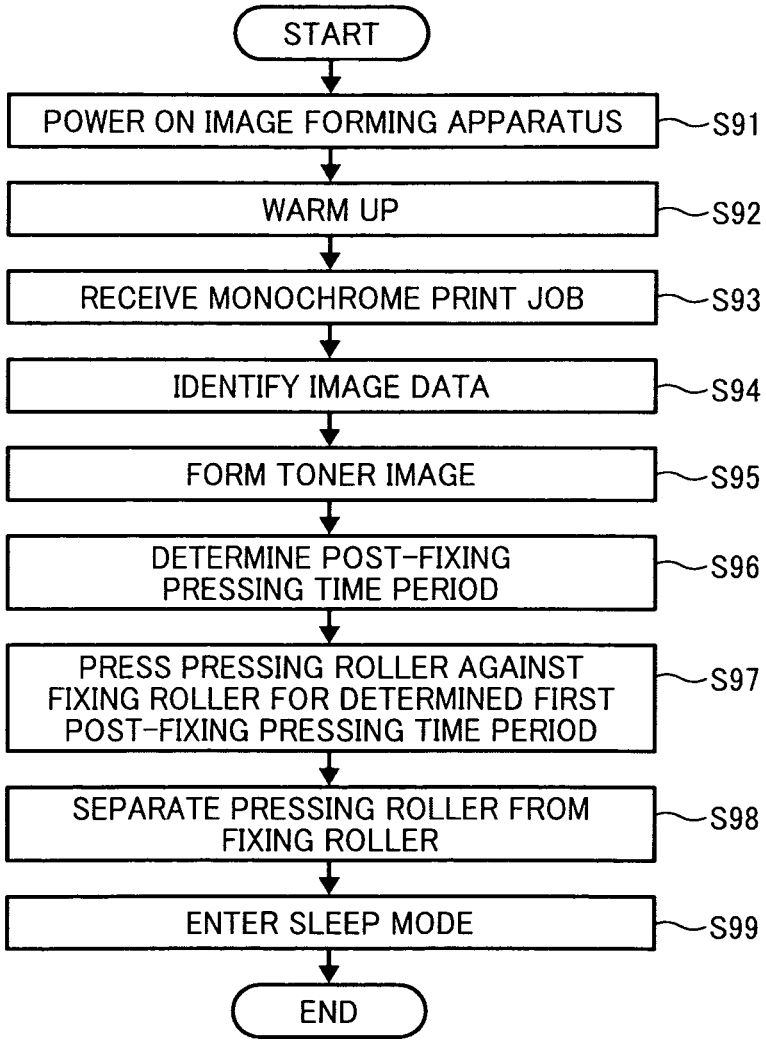
FIG. 5B is a flowchart showing one example of control processes performed by the image forming apparatus shown in FIG. 1 to form a monochrome toner image on a recording medium.

With the above-described configuration of the image forming apparatus 1, control processes shown in FIGS. 5A and 5B are performed. FIG. 5A is a flowchart showing control processes performed by the image forming apparatus 1 to form a color toner image on a recording medium P. FIG. 5B is a flowchart showing control processes performed by the image forming apparatus 1 to form a monochrome toner image on a recording medium P.

As shown in FIGS. 5A and 5B, in steps S11 and S91, that is, in a power-on process, the image forming apparatus 1 is powered on.

In steps S12 and S92, that is, in a warm-up standby process, the above-described components installed in the image forming apparatus 1 and used for image formation are warmed up and then enter a standby mode in which the image forming apparatus 1 waits for a print job.

In steps S13 and S93, that is, in a job reception process, the image forming apparatus 1 receives a print job. Specifically, in step S13 shown in FIG. 5A, the image forming apparatus 1 receives a print job for forming a color toner image on a recording medium P. In step S93 shown in FIG. 5B, the image forming apparatus 1 receives a print job for forming a monochrome toner image on a recording medium P.

In steps S14 and S94, the controller 70 identifies image data contained in the print job.

In steps S15 and S95, that is, in an image forming process, the image forming apparatus 1 performs the image forming operation described above by referring to FIG. 1. Specifically, in the fixing device 19, the moving assembly 60 presses the pressing roller 30 against the fixing roller 20 to form the fixing nip N therebetween and the recording medium P bearing the toner image T is conveyed through the fixing nip N.

In steps S16 and S96, the controller 70 determines a first post-fixing pressing time period for which the pressing roller 30 presses against the fixing roller 20 after the last recording medium P of the print job is discharged from the fixing nip N.

If the image forming apparatus 1 does not receive a next print job after the last recording medium P of the previous print job is discharged from the fixing nip N of the fixing device 19, the image forming apparatus 1 enters the standby mode in steps S17 and S97, that is, in a post-fixing pressing process. For example, the fixing device 19 waits for the next print job for the first post-fixing pressing time period in the pressing state in which the pressing roller 30 presses against the fixing roller 20. Specifically, the fixing roller 20 and the pressing roller 30 do not rotate and the induction heater 25 does not heat the fixing roller 20 while the pressing roller 30 presses against the fixing roller 20 and the heater 33 still supplied with power heats the pressing roller 30 to keep the pressing roller 30 warmed. Thus, the fixing device 19 waits for the next print job.

When the image forming apparatus 1 does not receive the next print job even after the first post-fixing pressing time period elapses, the pressing roller 30 separates from the fixing roller 20 to release pressure applied therebetween in steps S18 and S98, that is, in a pressure release process. If the image forming apparatus 1 enters the sleep mode in a state in which the pressing roller 30 presses against the fixing roller 20, the pressing roller 30 may deform and damage the fixing roller 20. To address this problem, it is necessary to separate the pressing roller 30 from the fixing roller 20 before the image forming apparatus 1 enters the sleep mode.

In steps S19 and S99, that is, in a sleep process, the image forming apparatus 1 enters the sleep mode in which software and hardware components used for image formation are deactivated. Accordingly, the image forming apparatus 1 does not perform process control and thus consumes a minimal amount of power.

In the control processes shown in FIGS. 5A and 5B, the fixing device 19 is on standby for the next print job in the pressing state for a substantial period of time as shown in steps S17 and S97 before the image forming apparatus 1 enters the sleep mode, wasting power.

Figure 5C:
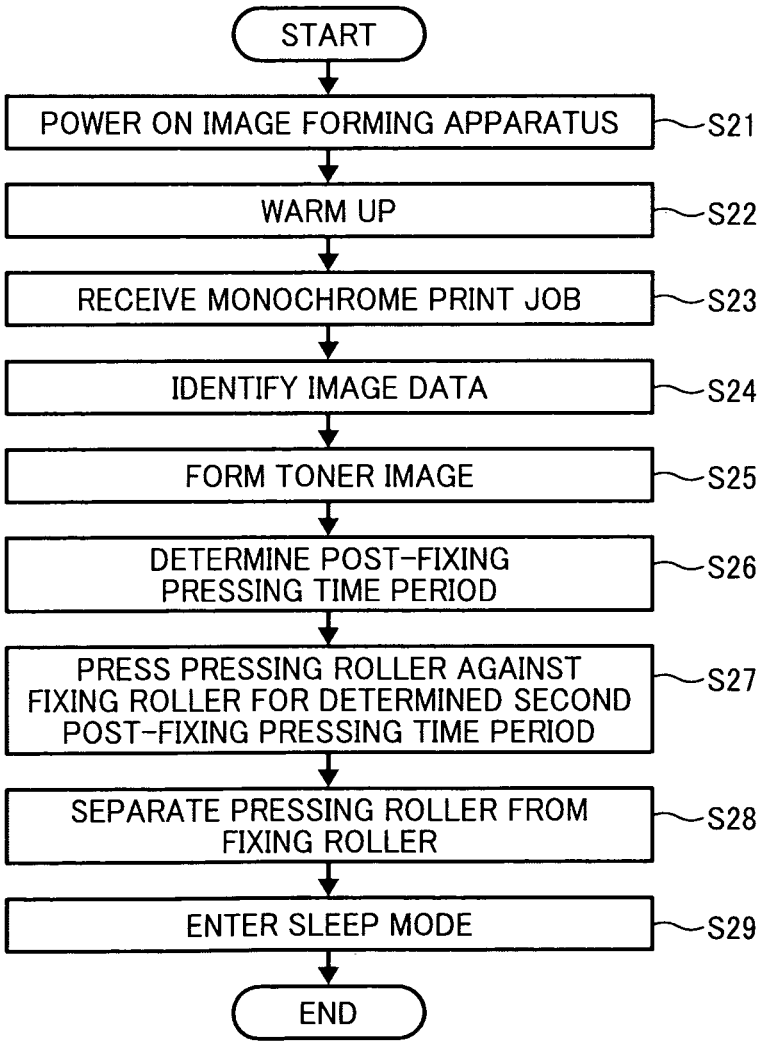
FIG. 5C is a flowchart showing another example of control processes performed by the image forming apparatus shown in FIG. 1 to form a monochrome toner image on a recording medium.

Accordingly, control processes shown in FIG. 5C may be performed. FIG. 5C is a flowchart showing control processes performed by the image forming apparatus 1 to form a monochrome toner image on a recording medium P.

In step S21, that is, in a power-on process, the image forming apparatus 1 is powered on.

In step S22, that is, in a warm-up standby process, the above-described components installed in the image forming apparatus 1 and used for image formation are warmed up and then enter the standby mode in which the image forming apparatus 1 waits for a print job.

In step S23, that is, in a job reception process, the image forming apparatus 1 receives a print job. Specifically, in step S23, the image forming apparatus 1 receives a print job for forming a monochrome toner image on the recording medium P.

In step S24, the controller 70 identifies image data contained in the print job.

In step S25, that is, in an image forming process, the image forming apparatus 1 performs the image forming operation described above by referring to FIG. 1. Specifically, in the fixing device 19, the moving assembly 60 presses the pressing roller 30 against the fixing roller 20 to form the fixing nip N therebetween and the recording medium P bearing the toner image T is conveyed through the fixing nip N.

In step S26, the controller 70 determines a second post-fixing pressing time period for which the pressing roller 30 presses against the fixing roller 20 after the last recording medium P of the print job is discharged from the fixing nip N. The second post-fixing pressing time period is substantially shorter than the first post-fixing pressing time period shown in FIGS. 5A and 5B in the pressing state in which the pressing roller 30 presses against the fixing roller 20.

If the image forming apparatus 1 does not receive a next print job after the last recording medium P of the previous print job is discharged from the fixing nip N of the fixing device 19, the image forming apparatus 1 enters the standby mode in step S27, that is, in a post-fixing pressing process. For example, the fixing device 19 waits for the next print job for the second post-fixing pressing time period.

When the image forming apparatus 1 does not receive the next print job even after the second post-fixing pressing time period elapses, the pressing roller 30 separates from the fixing roller 20 to release pressure applied therebetween in step S28, that is, in a pressure release process.

In step S29, that is, in a sleep process, the image forming apparatus 1 enters the sleep mode in which software and hardware components used for image formation are deactivated.

With the above-described control processes shown in FIG. 5C, the fixing device 19 is in the standby mode for a minimal amount of time after the last recording medium P of the print job is discharged from the fixing nip N and before the image forming apparatus 1 enters the sleep mode, thus minimizing power consumption.

The control processes shown in FIG. 5C may generate considerable noise as the pressing roller 30 separates from the fixing roller 20 frequently. Specifically, as shown in FIG. 3, as the cam 65 rotates and releases pressure applied therefrom to the second end E2 of the arm 63, the biasing member 54 exerts the bias f to the first end E1 of the arm 63 instantly, thus generating objectionable noise. Accordingly, when the cam 65 separates the pressing roller 30 from the fixing roller 20 immediately after the recording medium P is discharged from the fixing nip N, a user standing in front of the image forming apparatus 1 to pickup the recording medium P bearing the fixed toner image T may be uncomfortable with the noise.

To strike a balance between minimization of the noise and minimization of power consumption, after the recording medium P bearing the fixed toner image T is discharged from the fixing nip N and before the image forming apparatus 1 enters the sleep mode in which software and hardware components used for image formation are deactivated, the image forming apparatus 1 continues pressing the pressing roller 30 against the fixing roller 20, that is, the image forming apparatus 1 performs a post-fixing pressing process of pressing the pressing roller 30 against the fixing roller 20. Thereafter, the image forming apparatus 1 performs a pressure release process of separating the pressing roller 30 from the fixing roller 20.

Notably, a post-fixing pressing time period for which the pressing roller 30 presses against the fixing roller 20 in the post-fixing pressing process is varied according to image data used for image formation. The post-fixing pressing process provides a plurality of options as the post-fixing pressing time period for which the pressing roller 30 presses against the fixing roller 20. Preferably, the controller 70 selects a desired post-fixing pressing time period from among the plurality of options according to the image data used for image formation. The plurality of options includes the first post-fixing pressing time period that gives priority to extending the life of the fixing roller 20 and the pressing roller 30 and a second post-fixing pressing time period shorter than the first post-fixing pressing time period, which gives priority to reduction of power consumption. In other words, the controller 70 selects between the control processes shown in FIG. 5A and the control processes shown in FIG. 5C according to the image data.

More specifically, with the control processes shown in FIG. 5A, when the first post-fixing pressing time period elapses after the recording medium P bearing the fixed toner image T is discharged from the fixing nip N, the pressing roller 30 separates from the fixing roller 20, thus reducing the objectionable noise. Further, the frequency of pressing the pressing roller 30 against the fixing roller 20 and separating the pressing roller 30 from the fixing roller 20 is reduced in the entire operation time of the image forming apparatus 1, thus extending the life of the fixing roller 20 and the pressing roller 30. By contrast, with the control processes shown in FIG. 5C, the standby process of waiting for the next print job for the longer first post-fixing pressing time period indicated by step S97 in FIG. 5B is replaced by the standby process with the shorter second post-fixing pressing time period indicated by step S27 in FIG. 5C, thus minimizing waste of power.

For example, the first post-fixing pressing time period is variable within a range of from about 60 sec to about 60 min according to a usage condition of the image forming apparatus 1. The second post-fixing pressing time period is constant within a range of from about 0 sec to about 5 sec.

The image data used for image formation are constructed of color tone information (e.g., monochrome image or color image) and image pattern information (e.g., text image, solid image, linear image, or dotted image). For example, the image data define information of an image contained in print job signals of a particular print job input to the image forming apparatus 1. The monochrome image defines an image using one of yellow, magenta, cyan, and black. The color image defines an image using two or more of yellow, magenta, cyan, and black. An image using all of yellow, magenta, cyan, and black may be defined as a full color image. The text image is an image pattern requiring no image processing, that is, an image pattern consisting of letters and without the header and footer of a document format. The solid image is a solid, mosaic image pattern. The linear image is an image pattern made of a solid line with a given width such as a ruled line. The dotted image is an image pattern producing light and shade such as a halftone image.

The controller 70 selects the first post-fixing pressing time period or the second post-fixing pressing time period based on a combination of the color tone and the image pattern of the image data according to the usage condition of the image forming apparatus 1.

For example, if a higher priority is given to noise reduction than to power consumption reduction, and the image data indicate a monochrome image as the color tone and a text, solid, or linear image as the image pattern, the controller 70 selects the second post-fixing pressing time period. Otherwise the controller 70 selects the first post-fixing pressing time period.

The post-fixing pressing time period and the corresponding color tone and image pattern are shown in Table 1 below.

In Table 1, copy image is an image formed with a print job having image data obtained by using a copier function of the image forming apparatus 1. The other items in the image pattern column in Table 1 designate an image formed with a print job sent from an external device (e.g., a client computer) by using a printer function of the image forming apparatus 1. Photograph is an image formed according to image data obtained by shooting with a digital camera.

TABLE 1

| Post-fixing pressing time period | Image pattern |
|---|---|
| First post-fixing pressing time period | Copy image, color: photograph<br>Monochrome: halftone |
| Second post-fixing pressing time period | Monochrome: text, solid, ruled line |

As described above, in the control processes shown in FIGS. 5A and 5C including the image forming process indicated by steps S15 and S25, the post-fixing pressing process indicated by steps S17 and S27, the pressure release process indicated by steps S18 and S28, and the sleep process indicated by steps S19 and S29 performed in this order, the post-fixing pressing time period in the post-fixing pressing process is changed according to image data used for forming the toner image T on the recording medium P. Accordingly, the fixing device 19 can strike a balance between minimization of noise generated as the pressing roller 30 separates from the fixing roller 20 and minimization of power consumption.

If the image forming apparatus 1 is a multifunction printer having the printer function and the copier function, the first post-fixing pressing time period and the second post-fixing pressing time period in the post-fixing pressing process are changed according to the function used for forming the toner image T on the recording medium P, that is, the printer function or the copier function, in addition to the image data used for forming the toner image T on the recording medium P.

The post-fixing pressing time period and the corresponding color tone and function used for image formation are shown in Table 2 below.

When a monochrome toner image T is formed by using the printer function, the controller 70 selects the first post-fixing pressing time period or the second post-fixing pressing time period. Otherwise, the controller 70 selects the first post-fixing pressing time period. Further, when the monochrome toner image T is formed by using the printer function, the first post-fixing pressing time period or the second post-fixing pressing time period is selected with reference to Table 1 also.

TABLE 2

| | Color | Monochrome |
|---|---|---|
| Copier | First post-fixing pressing time period | First post-fixing pressing time period |
| Printer | First post-fixing pressing time period | First post-fixing pressing time period or Second post-fixing pressing time period |

If the controller 70 receives an instruction to enter the sleep mode during the post-fixing pressing process indicated by steps S17, S97, and S27 in FIGS. 5A, 5B, and 5C, the controller 70 finishes the post-fixing pressing process and transits to the pressure release process indicated by steps S18, S98, and S28 in FIGS. 5A, 5B, and 5C.

When the pressure release process is finished, the post-fixing pressing time period in the post-fixing pressing process is initialized to a default post-fixing pressing time period. For example, the default post-fixing pressing time period defines the relatively longer first post-fixing pressing time period so that the pressing roller 30 does not separate from the fixing roller 20 immediately after the recording medium P bearing the fixed toner image T is discharged from the fixing nip N.

As described by referring to FIGS. 4A, 4B, 4C, and 4D, the moving assembly 60 provides the plurality of levels of pressure applied from the pressing roller 30 to the fixing roller 20. The identical level of pressure is used before and after the recording medium P bearing the fixed toner image T is discharged from the fixing nip N.

The control processes and the corresponding levels of pressure are shown in Table 3 below. In Table 3, pressure level 2 is greater than pressure level 1, and pressure level 3 is greater than pressure level 2.

TABLE 3

| | Before recording medium is discharged from fixing nip | After recording medium is discharged from fixing nip | After post-fixing pressing time period elapses |
|---|---|---|---|
| Pressing pattern 1 | Pressure level 1 | Pressure level 1 | Release pressure |
| Pressing pattern 2 | Pressure level 2 | Pressure level 2 | Release pressure |

TABLE 3-continued

| | Before recording medium is discharged from fixing nip | After recording medium is discharged from fixing nip | After post-fixing pressing time period elapses |
|---|---|---|---|
| Pressing pattern 3 | Pressure level 3 | Pressure level 3 | Release pressure |

In each of pressing patterns 1 to 3, the controller 70 maintains the level of pressure after the recording medium P bearing the fixed toner image T is discharged from the fixing nip N to be equivalent to the level of pressure before the recording medium P is discharged from the fixing nip N, that is, while the recording medium P passes through the fixing nip N.

As described above, the cam 65 rotates and changes the level of pressure. However, if the cam 65 changes the level of pressure frequently before the pressing roller 30 separates from the fixing roller 20, the cam 65 may wear out prematurely and/or generate noise. To address this problem, the identical level of pressure is maintained before and after the recording medium P bearing the fixed toner image T is discharged from the fixing nip N.

If the image forming apparatus 1 receives a print job that requires a different level of pressure while the pressing roller 30 presses against the fixing roller 20 in the post-fixing pressing process shown by steps S17, S97, and S27, the pressing roller 30 separates from the fixing roller 20 and then presses against the fixing roller 20 again with the different level of pressure before the given post-fixing pressing time period, that is, the first post-fixing pressing time period or the second post-fixing pressing time period, elapses.

The moving assembly 60 varies the level of pressure with which the pressing roller 30 presses against the fixing roller 20 while the recording medium P bearing the toner image T passes through the fixing nip N depending on a thickness and a conveyance speed (e.g., a linear velocity) of the recording medium P at the fixing nip N. Since a desired level of pressure with which the pressing roller 30 presses against the fixing roller 20 varies depending on the type, that is, the thickness, of the recording medium P, the desired level of pressure is selected from among the different levels of pressure to prevent a leading edge of the recording medium P from damaging the fixing roller 20 and to prevent the recording medium P from creasing. The different levels of pressure corresponding to the type of the recording medium P are shown in Table 4 below.

TABLE 4

| Paper type | Paper weight ($g/m^2$) | Pressure level* Standard speed | Pressure level* Low speed |
|---|---|---|---|
| Thin paper | 52 or less | 3 | 3 |
| Plain paper 1 and 2 | 53 to 81 | 3 | 3 |
| Medium thickness paper | 82 to 105 | 3 | 3 |
| Thick paper 1 | 106 to 169 | 3 | 3 |
| Thick paper 2 | 170 to 220 | — | 2 |
| Thick paper 3 | 221 to 255 | — | 2 |
| Thick paper 4 | 256 or more | — | 2 |

*The greater number denotes the greater pressure.

As shown in Table 4, there are two conveyance speeds at which the recording medium P is conveyed through the fixing nip N: a standard speed and a low speed.

The seven types of the recording medium P available are: thin paper, plain paper 1 and 2, medium thickness paper, thick paper 1, thick paper 2, thick paper 3, and thick paper 4. Pressure level 3 is selected for thin paper, plain paper 1 and 2, medium thickness paper, and thick paper 1 even when the recording medium P is conveyed either at the standard speed or at the low speed. By contrast, for thick paper 2, thick paper 3, and thick paper 4 which have relatively greater paper weights, pressure level 2 is selected to extend the life of the fixing roller 20 and the pressing roller 30 and the low speed is selected to increase a fixing time for which the recording medium P is conveyed through the fixing nip N.

The present invention has been described above with reference to specific example embodiments illustrated in the drawings. Nonetheless, the present invention is not limited to the details of example embodiments described above, but various modifications and improvements are possible without departing from the spirit and scope of the present invention. For example, according to the above-described example embodiments, the movement of the biasing member 54 to release pressure applied from the pressing roller 30 to the fixing roller 20 generates noise. However, the present invention is applicable to any configuration that may generate noise as pressure applied at a nip formed between two opposed components is released.

The fixing device 19 depicted in FIG. 2 includes the induction heater 25. Alternatively, the induction heater 25 may be omitted so that the heater 33 heats the fixing roller 20 via the pressing roller 30 or the induction heater 25 may be replaced by a halogen heater.

Figure 6:
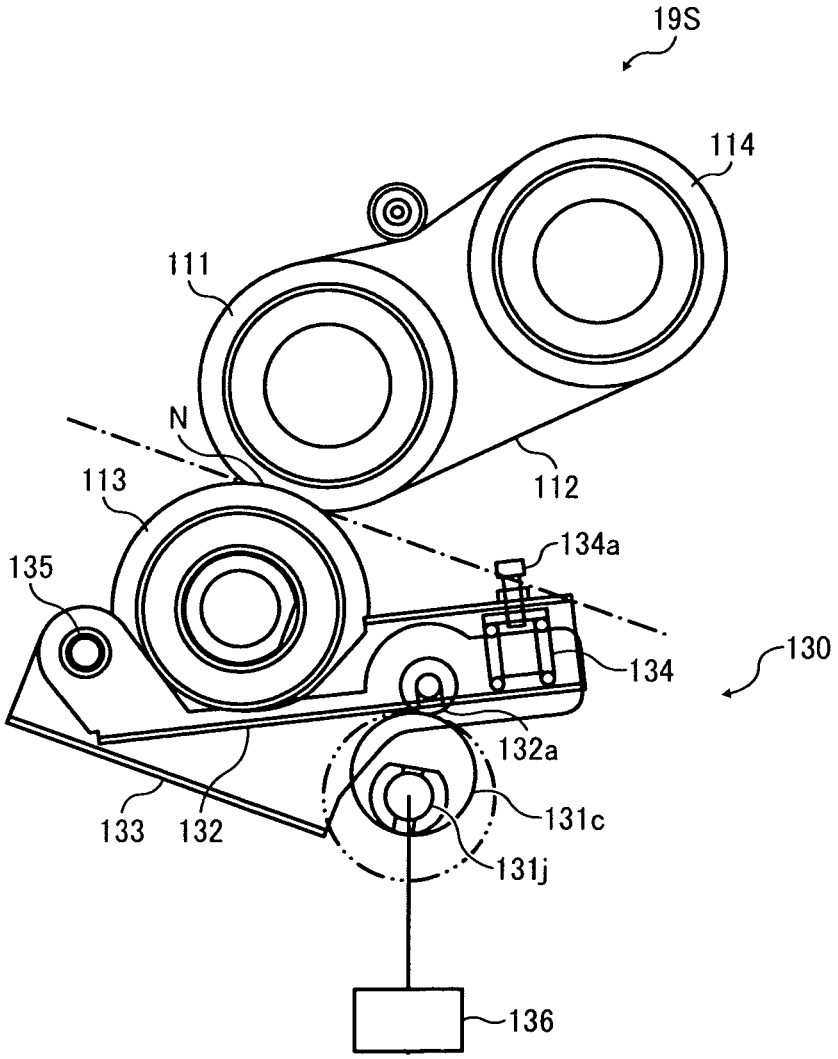
FIG. 6 is a vertical sectional view of a fixing device according to another example embodiment.

The present invention is also applicable to a fixing device having an endless belt shaped fixing rotary body instead of the roller shaped fixing rotary body, that is, the fixing roller 20. FIG. 6 is a vertical sectional view of a fixing device 19S having a fixing belt 112 as an endless belt shaped fixing rotary body.

As illustrated in FIG. 6, the fixing device 19S includes the fixing belt 112 stretched over a fixing roller 111 and a heating roller 114 with a given tension; a pressing roller 113 serving as a pressing rotary body rotatably pressed against the fixing roller 111 via the fixing belt 112 to form the fixing nip N between the pressing roller 113 and the fixing belt 112; and a moving assembly 130 that moves the pressing roller 113 to press the pressing roller 113 against the fixing belt 112 and separate the pressing roller 113 from the fixing belt 112.

A detailed description is now given of the moving assembly 130.

The moving assembly 130 includes a first arm 132 and a second arm 133. The second arm 133 serves as a support that supports the pressing roller 113 in such a manner that the pressing roller 113 is movable toward the fixing roller 111 to press against the fixing roller 111 via the fixing belt 112 and away from the fixing roller 111 to release pressure applied to the fixing roller 111. The first arm 132 is connected to the second arm 133 via a biasing member 134 and serves as a driver that drives and presses against the second arm 133. The moving assembly 130 further includes an actuator 136, when supplied with power, driven and then stopped at a given position; and a transmitter that transmits a driving force generated by the actuator 136 to the first arm 132. With this configuration, when the actuator 136 is supplied with power and generates a driving force, the transmitter transmits the driving force to the first arm 132 to cause the first arm 132 to press against the second arm 133. Accordingly, the second arm 133 presses the pressing roller 113 against the fixing roller 111 via the fixing belt 112 with a given pressure.

The moving assembly 130 further includes the biasing member 134 and a support shaft 135. The biasing member 134 (e.g., a spring) is mounted on one end of the first arm 132 and one end of the second arm 133 in a longitudinal direction thereof. The support shaft 135 is mounted on a frame of the fixing device 19S and supports another end of the first arm 132 and another end of the second arm 133 in the longitudinal direction thereof, thus serving as a rotation axis of the first arm 132 and the second arm 133.

The moving assembly 130 further includes a pressure adjuster 134*a* constructed of a screw and a locknut and attached to an end of the biasing member 134 which is disposed opposite the second arm 133.

The moving assembly 130 further includes a cam 131*c* that supports the first arm 132 and is rotated by the driving force of the actuator 136. A cam follower 132*a* (e.g., a cam follower roller) is attached to the first arm 132 at a support position where the cam 131*c* contacts and supports the first cam 132. Accordingly, as the driving force of the actuator 136 is transmitted to the first arm 132, the support position on the cam 131*c* where the cam 131*c* supports the first arm 132 changes.

The cam 131*c*, the first arm 132, the second arm 133, the biasing member 134, and the support shaft 135 are disposed on each lateral end of the pressing roller 113 in an axial direction thereof, thus constituting a pair of cam and its peripherals that exerts a force to both lateral ends of the pressing roller 113 in the axial direction thereof. The pair of cams 131*c* is interlocked with each other via a cam drive shaft 131*j*. As the cam drive shaft 131*j* rotates, the pair of cams 131*c* rotates in accordance with rotation of the cam drive shaft 131*j*.

A disciform encoder is attached to the cam drive shaft 131*j*. As a photo sensor detects a rotation position of the encoder, the controller 70 operatively connected to the photo sensor detects a phase of the cam 131*c*, detecting whether the pressing roller 113 is pressed against the fixing roller 111 via the fixing belt 112 or is isolated from the fixing belt 112. Accordingly, based on the phase of the cam 131*c* detected by the photo sensor, the controller 70 stops the actuator 136 that drives the cam 131*c* at a desired position to switch between a pressing state in which the pressing roller 113 presses against the fixing roller 111 via the fixing belt 112 and a pressure release state in which the pressing roller 113 is isolated from the fixing belt 112. Additionally, the controller 70 stops the actuator 136 at a desired position to press the pressing roller 113 against the fixing roller 111 with a desired pressure selectable from among a plurality of different levels of pressure.

Referring to FIG. 6, the following describes a pressing operation of the moving assembly 130 to move the pressing roller 113 toward the fixing roller 111 to press the pressing roller 113 against the fixing roller 111 via the fixing belt 112 and a pressure release operation to move the pressing roller 113 away from the fixing roller 111 to release pressure applied from the pressing roller 113 to the fixing roller 111.

A detailed description is now given of the pressing operation of the moving assembly 130.

As the actuator 136 is driven and rotated by power supplied thereto, a driving force is transmitted from the actuator 136 to the drive shaft 131*j* via the transmitter, thus rotating the drive shaft 131*j*. As the cam 131*c* rotates by a given angle in accordance with rotation of the drive shaft 131*j*, the cam 131*c* lifts the cam follower 132*a* attached to the first arm 132.

Accordingly, the first arm 132 rotates about the support shaft 135. In accordance with rotation of the first arm 132, the biasing member 134 also rotates, which is mounted on the right end in FIG. 6 of the first arm 132 opposite the left end in FIG. 6 in the longitudinal direction of the first arm 132 where the support shaft 135 is mounted. Thus, the biasing member 134 lifts the right end of the second arm 133 with a given pressure. Accordingly, the second arm 133 rotates about the support shaft 135.

Subsequently, a pressing portion of the second arm 133 disposed between the biasing member 134 and the support shaft 135 in the longitudinal direction of the first arm 132 contacts a roller shaft of the pressing roller 113, pressing the pressing roller 113 toward the fixing roller 111.

Finally, as the pressing portion of the second arm 133 moves the roller shaft of the pressing roller 113 toward the fixing roller 111, the pressing roller 113 presses against the fixing roller 111 via the fixing belt 112 with a given pressure according to a phase of the cam 131*c* and a bias of the biasing member 134, thus forming the fixing nip N between the pressing roller 113 and the fixing belt 112.

A detailed description is now given of the pressure release operation of the moving assembly 130.

As the driving force of the actuator 136 further rotates the cam 131*c* by a given angle from the position where the actuator 136 presses the pressing roller 113 against the fixing roller 111, the cam 131*c* no longer lifts the cam follower 132*a* of the first arm 132.

Accordingly, the first arm 132 is rotated about the support shaft 135 by a bias of a biasing member connected to the first arm 132 in a direction opposite a direction in which the first arm 132 rotates to press the pressing roller 113 against the fixing roller 111 as described above. Simultaneously, the right end in FIG. 6 of the second arm 133 is biased in a direction opposite a direction in which the second arm 133 rotates to press the pressing roller 113 against the fixing roller 111 as described above together with the biasing member 134 mounted on the right end in FIG. 6 of the first arm 132. Further, the weight of the pressing roller 113 lowers the right end in FIG. 6 of the second arm 133 in a direction opposite a direction in which the right end of the second arm 133 lifts and presses the pressing roller 133 against the fixing roller 111.

As the right end of the second arm 133 lowers, the second arm 133 rotates about the support shaft 135 in a direction opposite a direction in which the right end of the second arm 133 rotates to press the pressing roller 113 against the fixing roller 111 as described above.

Subsequently, the pressing portion of the second arm 133 disposed between the right end of the second arm 133 and the support shaft 135 rotates in a direction opposite a direction in which the pressing portion of the second arm 133 presses the pressing roller 113 against the fixing roller 111. Thus, the pressing portion of the second arm 133 separates from the roller shaft of the pressing roller 113.

That is, the pressing portion of the second arm 133 does not press the pressing roller 113 against the fixing roller 111. Accordingly, the pressing roller 113 separates from the fixing roller 111, releasing pressure applied at the fixing nip N.

As described above, before the image forming apparatus 1 enters the sleep mode, the moving assembly 130 separates the pressing roller 113 from the fixing roller 111, thus releasing pressure applied therebetween at the fixing nip N.

As described above, the image forming apparatus 1 depicted in FIG. 1 installed with the fixing device (e.g., the fixing device 19 or 19S depicted in FIG. 2 or 6) performs the image forming process (e.g., steps S15, S95, and S25 in FIGS. 5A, 5B, and 5C), the post-fixing pressing process (e.g., steps S17, S97, and S27), the pressure release process (e.g., steps S18, S98, and S28), and the sleep process (e.g., steps S19, S99, and S29) in this order. The post-fixing pressing time period for which the pressing rotary body (e.g., the pressing roller 30 or 113) presses against the fixing rotary body (e.g., the fixing roller 20 or the fixing belt 112) in the post-fixing pressing process is changed according to image data based on which the toner image T is formed on the recording medium P. Accordingly, the fixing device balances between minimization of noise that may generate when the pressing rotary body separates from the fixing rotary body and minimization of power consumption.

The present invention has been described above with reference to specific example embodiments. Nonetheless, the present invention is not limited to the details of example embodiments described above, but various modifications and improvements are possible without departing from the spirit and scope of the present invention. It is therefore to be understood that within the scope of the associated claims, the present invention may be practiced otherwise than as specifically described herein. For example, elements and/or features of different illustrative example embodiments may be combined with each other and/or substituted for each other within the scope of the present invention.

What is claimed is:

1. An image forming apparatus comprising:

an image forming device to form a toner image on a recording medium according to image data a fixing device disposed downstream from the image forming device in a recording medium conveyance direction to fix the toner image on the recording medium, the fixing device including, a fixing rotary body rotatable in a predetermined direction of rotation, a pressing rotary body separatably pressed against the fixing rotary body to form a nip therebetween through which the recording medium bearing the toner image passes, and a moving assembly operatively connected to the pressing rotary body to move the pressing rotary body bidirectionally to alternately press the pressing rotary body against the fixing rotary body and separate the pressing rotary body from the fixing rotary body; and a controller operatively connected to the moving assembly to control the moving assembly by setting a post-fixing pressing time period, the post-fixing pressing time period being a period of time which the moving assembly continues pressing the pressing rotary body against the fixing rotary body after the recording medium bearing the toner image is discharged from the nip, wherein the image data include monochrome or color image color tone and at least one of text, solid, linear, and dotted image patterns, the post-fixing pressing time period is selectable from among a plurality of options that includes a first post-fixing pressing time period and a second post-fixing pressing time period shorter than the first post-fixing pressing time period, and the controller is configured to select the second post-fixing pressing time period when the image data includes the monochrome image color tone and one of the text, solid, and linear image patterns.

2. The image forming apparatus according to claim 1, wherein the first post-fixing pressing time period is variable.

3. The image forming apparatus according to claim 1, wherein the image forming apparatus has a printer function and a copier function, and the controller changes the post-fixing pressing time period according to the function.

4. The image forming apparatus according to claim 3, wherein the controller selects the second post-fixing pressing time period when the printer function is used and the image data include the monochrome image color tone.

5. The image forming apparatus according to claim 1, wherein the moving assembly presses the pressing rotary body against the fixing rotary body with a pressure level selectable from among a plurality of options, and the pressing rotary body presses against the fixing rotary body with the identical pressure level both before and after the recording medium bearing the toner image is discharged from the nip.

6. The image forming apparatus according to claim 1, wherein the moving assembly presses the pressing rotary body against the fixing rotary body with a pressure level selectable from among a plurality of options, and the controller selects the pressure level based on a thickness of the recording medium and a conveyance speed at which the recording medium is conveyed through the nip, and wherein the pressing rotary body presses against the fixing rotary body with the selected pressure level while the recording medium passes through the nip.

7. The image forming apparatus according to claim 1, wherein the fixing device further comprises a biasing member mounted on the moving assembly to bias the moving assembly.

8. The image forming apparatus according to claim 1, wherein the controller is configured to identify the image data by analyzing an electronic version of the image data contained in the print job.

9. The image forming apparatus according to claim 8, wherein the controller is configured to, determine if a last recording medium of the print job is discharged from the nip, and instruct the moving assembly to enter a standby mode where the pressing rotary body remains pressed against the fixing rotary body for the post-fixing pressing time period, if the controller determines a last one of the recording medium related to the print job has discharged from the nip, where the post-fixing pressing time varies according to the analysis of the electronic version of the image data.

10. A method for forming a toner image on a recording medium performed by an image forming apparatus, comprising steps of:

powering on the image forming apparatus;

warming up the image forming apparatus;

identifying image data contained in a print job;

forming the toner image on the recording medium according to the identified image data;

pressing a pressing rotary body against a fixing rotary body to form a nip therebetween;

conveying the recording medium bearing the toner image through the nip to fix the toner image on the recording medium;

determining a post-fixing pressing time period for which the pressing rotary body is pressed against the fixing rotary body after the recording medium bearing the toner image is discharged from the nip according to the identified image data;

pressing the pressing rotary body against the fixing rotary body for the determined post-fixing pressing time period after the recording medium bearing the toner image is discharged from the nip;

separating the pressing rotary body from the fixing rotary body after the determined post-fixing pressing time period elapses; and deactivating software and hardware components installed in the image forming apparatus used for forming the toner image on the recording medium, wherein the post-fixing pressing time period is selectable from among a plurality of options that includes a first post-fixing pressing time period and a second post-fixing pressing time period shorter than the first post-fixing pressing time period, the image data include monochrome or color image color tone and at least one of text, solid, linear, and dotted image patterns, and the second post-fixing pressing time period is selected when the image data include the monochrome image color tone and one of the text, solid, and linear image patterns.

11. The method according to claim 10, wherein the first post-fixing pressing time period is variable.

12. The method according to claim 10, wherein the image forming apparatus has a printer function and a copier function, and the post-fixing pressing time period is determined according to the function.

13. The method according to claim 12, wherein the second post-fixing pressing time period is selected when the printer function is used and the image data include the monochrome image color tone.

14. The method according to claim 10, wherein the determined post-fixing pressing time period is shortened when the image forming apparatus receives an instruction to deactivate the software and hardware components installed in the image forming apparatus used for forming the toner image on the recording medium while pressing the pressing rotary body against the fixing rotary body after the recording medium bearing the toner image is discharged from the nip.

15. The method according to claim 10, wherein the determined post-fixing pressing time period is initialized after separating the pressing rotary body from the fixing rotary body after the determined post-fixing pressing time period elapses.

16. The method according to claim 10, further comprising a step of selecting from among a plurality of options a pressure level with which the pressing rotary body presses against the fixing rotary body both before and after the recording medium bearing the toner image is discharged from the nip.

17. The method according to claim 10, further comprising a step of selecting from among a plurality of options a pressure level with which the pressing rotary body presses against the fixing rotary body based on a thickness of the recording medium and a conveyance speed at which the recording medium is conveyed through the nip.

* * * * *